US007855500B2

(12) United States Patent
Ha

(10) Patent No.: US 7,855,500 B2
(45) Date of Patent: Dec. 21, 2010

(54) ELECTRON EMISSION DEVICE HAVING A SEALING MEMBER IN CONTACT WITH ELECTRODES

(75) Inventor: Jae-Sang Ha, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 327 days.

(21) Appl. No.: 11/714,802

(22) Filed: Mar. 7, 2007

(65) Prior Publication Data

US 2007/0252510 A1 Nov. 1, 2007

(30) Foreign Application Priority Data

Apr. 26, 2006 (KR) ..... 10-2006-0037681

(51) Int. Cl.
*H01J 1/62* (2006.01)
*G09G 3/22* (2006.01)

(52) U.S. Cl. ..... 313/497; 313/495; 315/169.1; 345/75.2

(58) Field of Classification Search ..... 313/495, 313/496, 497, 309, 336, 351; 315/169.1–169.4; 345/74.1, 75.1, 75.2
See application file for complete search history.

(56) References Cited

U.S. PATENT DOCUMENTS 3,631,287 A * 12/1971 Hoehn ..... 313/484
5,706,069 A 1/1998 Hermens et al.
5,850,120 A * 12/1998 Okamoto ..... 313/336
6,172,732 B1 1/2001 Hayakawa et al.
6,351,064 B1 2/2002 Frayssinet
2003/0071560 A1 4/2003 Komatsu et al.
2004/0056582 A1 3/2004 Nakamura et al.
2004/0164665 A1 * 8/2004 Sasaki et al. ..... 313/495
2004/0224187 A1 11/2004 Kang et al.

(Continued)

FOREIGN PATENT DOCUMENTS

EP 1 777 725 4/2007

OTHER PUBLICATIONS

European Search Report corresponding to European Patent Application No. 07106989.2, issued on Jun. 19, 2007.

(Continued)

*Primary Examiner*—Nimeshkumar D Patel
*Assistant Examiner*—Steven Horikoshi
(74) *Attorney, Agent, or Firm*—Robert E. Bushnell, Esq.

(57) ABSTRACT

An electron emission display that can mitigate or prevent problems of an arc discharge and a wire disconnection due to increases in resistance at portions where a sealing member contacts electrodes includes: an electron emission device on which upper surfaces of electrodes are exposed, a front panel that is disposed in front of the electron emission device, the front panel being of a phosphor material, and a sealing member that seals a space formed by the electron emission device and the front panel by being disposed on the edges of the space in contact with the electrodes. The electrodes are formed on an entire surface of the electron emission device with a narrow width at an end portion of the electron emission device where the electrodes are connected to an external power source, and the sealing member contacts the electrodes closer to the space than end portions of the electrodes where the width of the electrodes is narrowed.

14 Claims, 7 Drawing Sheets

U.S. PATENT DOCUMENTS

| | | | | |
|---|---|---|---|---|
| 2005/0077823 | A1* | 4/2005 | Song et al. | 313/582 |
| 2005/0082977 | A1 | 4/2005 | Kwon et al. | |
| 2005/0116612 | A1* | 6/2005 | Oh | 313/497 |
| 2005/0184647 | A1 | 8/2005 | Chang | |
| 2006/0043877 | A1* | 3/2006 | Inoue et al. | 313/496 |

OTHER PUBLICATIONS

Registration Determination Certificate issued by the Chinese Intellectual Property office on Sep. 29, 2010 for a corresponding Chinese Patent Application No. 200710102662.X and Request for Entry of the Accompanying Document herewith.

* cited by examiner

ELECTRON EMISSION DEVICE HAVING A SEALING MEMBER IN CONTACT WITH ELECTRODES

CLAIM OF PRIORITY

This application makes reference to, incorporates the same herein, and claims all benefits accruing under 35 U.S.C. §119 from an application for ELECTRON EMISSION DISPLAY DEVICE earlier filed in the Korean Intellectual Property Office on the 26 Apr. 2006 and there duly assigned Serial No. 10-2006-0037681.

BACKGROUND OF THE INVENTION

1. Field of the Invention

The present invention relates to an electron emission display, and more particularly, to an electron emission display that can solve problems of increased resistance, arc discharge, and wire disconnection at electrodes exposed on an upper part of the electron emission display.

2. Description of the Related Art

In general, electron emission devices use thermionic cathodes and cold cathodes as electron emission sources. The types of electron emission devices that use cold cathodes include a field emission devices (FEDs), a Surface Conduction Emitter (SCE) devices, Metal-Insulator-Metal (MIM) devices, Metal-Insulator-Semiconductor (MIS) devices, and Ballistic electron Surface Emitting (BSE) devices.

The FED devices are based on the principle that electrons are readily emitted due to a field emission difference in a vacuum when a material having a low work function or a high β function is used as an electron emission source. Electron emission sources formed of a material that uses molybdenum or silicon as the main material having a sharp tip, a carbon material such as graphite, a Diamond like Carbon (DLC), etc., or a nano material such as nano-tubes or nano-wires have been recently developed.

The SCE device is an electron emission source in which fine cracks are formed on a conductive thin film after the conductive thin film is formed between first and second electrodes disposed facing each other on a substrate. The SCE device is based on the principle that electrons are emitted from fine cracks, which are electron emission sources, when a current flows through a surface of the conductive thin film by supplying a voltage to the first and second electrodes.

The MIM and MIS devices are based on the principle that when electron emission sources respectively having MIM and MIS structures are formed, electrons are emitted and accelerated toward a metal having a low electron potential from a metal or a semiconductor having a high electron potential when a voltage is supplied between both metals or a metal and a semiconductor which have a dielectric layer interposed therebetween.

The BSE device is based on the principle that electrons are not dispersed but rather travel in a straight line when the size of a semiconductor is reduced to a dimension smaller than a mean free path distance of electrons in the semiconductor. The BSE device is an electron emission device that emits electrons when a voltage is supplied to an ohmic electrode and a metal thin film after an electron supplying layer comprising a metal or a semiconductor is formed on the ohmic electrode and an insulating layer and the metal thin film are formed on the electron supplying layer.

FIG. 1 is a partial exploded perspective view of a conventional electron emission display that uses an FED, and FIG. 2 is a plan view of the electron emission device of FIG. 1.

Referring to FIGS. 1 and 2, the electron emission display 100 includes a front panel 90 having a phosphor material on a front surface of an electron emission device 101, and a space formed by the front panel 90 and the electron emission device 101 is supported by spacers 60. Also, although FIGS. 1 and 2 are depicted in a partial state, the space must be maintained as a vacuum. Therefore, the space between the electron emission device 101 and the front panel 90 is sealed using a sealing member.

As depicted in FIG. 1, if the electron emission device 101 has a structure in which the electrodes are exposed on an upper surface of the electron emission device 101, the sealing member contacts the electrodes. When the sealing member contacts the electrodes, resistance in the electrodes formed in a thin film is increased. The increase in resistance in the electrodes increases an overall driving voltage of the electron emission display 101 and reduces luminescence efficiency. In particular, when the electrodes having a narrow width contact the sealing member and current flows in the electrodes, a problem of an arc discharge or a wire disconnection may result. Therefore, there is a need to develop a method to solve the increased resistance, the arc discharge, and wire disconnection problems.

SUMMARY OF THE INVENTION

The present invention provides an electron emission display that can mitigate or prevent problems of increased resistance, arc discharge, and wire disconnection at portions where a sealing member contacts electrodes.

According to an aspect of the present invention, an electron emission display is provided including: an electron emission device includes electrodes having exposed upper surfaces; a front panel arranged in front of the electron emission device, the front panel including a phosphor material; and a sealing member adapted to seal a space defined by the electron emission device and the front panel, the sealing member being disposed on edges of the space contacting the electrodes; the electrodes are arranged on an entire surface of the electron emission device, the electrodes having narrow portions arranged at an end portion of the electron emission device where the electrodes are arranged to be connected to an external power source; and the sealing member contacts the electrodes closer to the space than the end portions of the electrodes where the narrow portions of the electrodes are arranged.

The phosphor material preferably generates visible light upon being excited by accelerated electrons.

The front panel preferably further includes: a front substrate arranged parallel to the electron emission device and facing the electron emission device; and an anode arranged under the front substrate close to the phosphor material to accelerate electrons emitted by an electron emission source toward the phosphor material.

The electron emission device preferably includes: a base substrate; a plurality of cathodes arranged on the base substrate; and a plurality of gate electrodes electrically insulated from the cathodes; the electrodes exposed on an upper surface of the base substrate are gate electrodes. The electron emission device preferably alternatively includes: a base substrate; a plurality of cathodes arranged on the base substrate; a plurality of gate electrodes electrically insulated from the cathodes; and a plurality of focusing electrodes disposed above the gate electrodes and electrically insulated from the cathodes; the electrodes exposed on an upper surface of the electron emission device are focusing electrodes.

The sealing member preferably includes frit glass.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully below with reference to the accompanying drawings in which exemplary embodiments of the present invention are shown.

Figure 1:
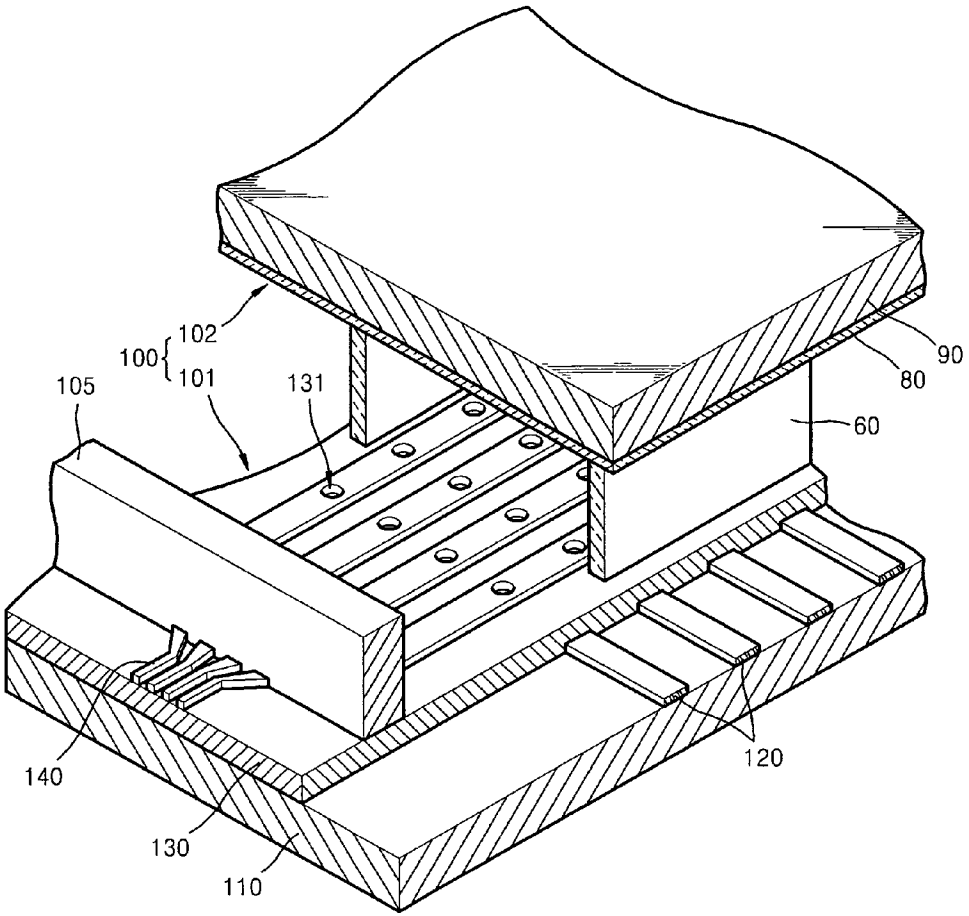
FIG. 1 (PRIOR ART)
FIG. 1 is a partial perspective view of a conventional electron emission display that uses a FED.
Figure 2:
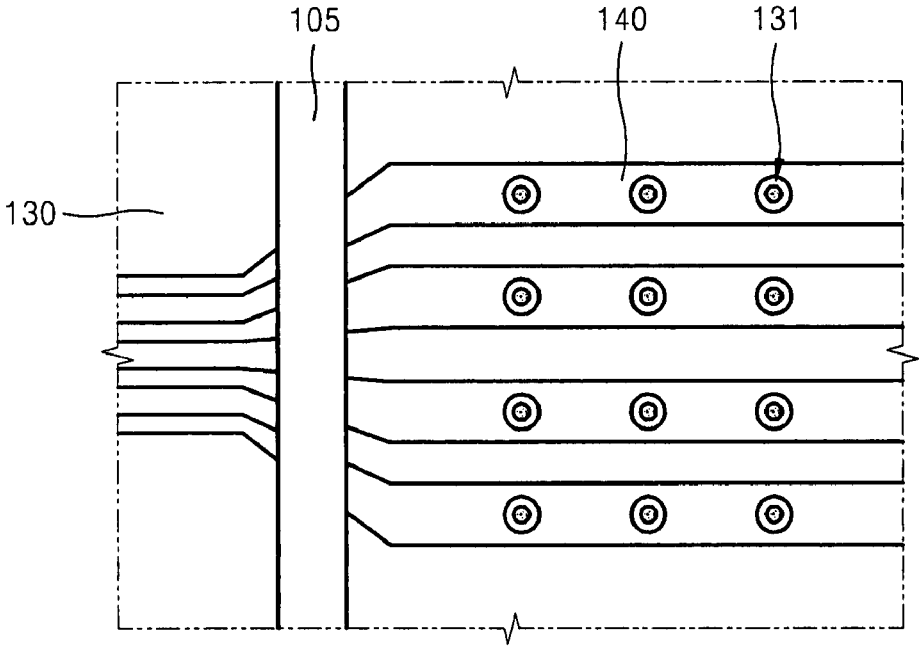
FIG. 2 (PRIOR ART)
FIG. 2 is a plan view of the field emission device (FED) of FIG. 1.
Figure 3:
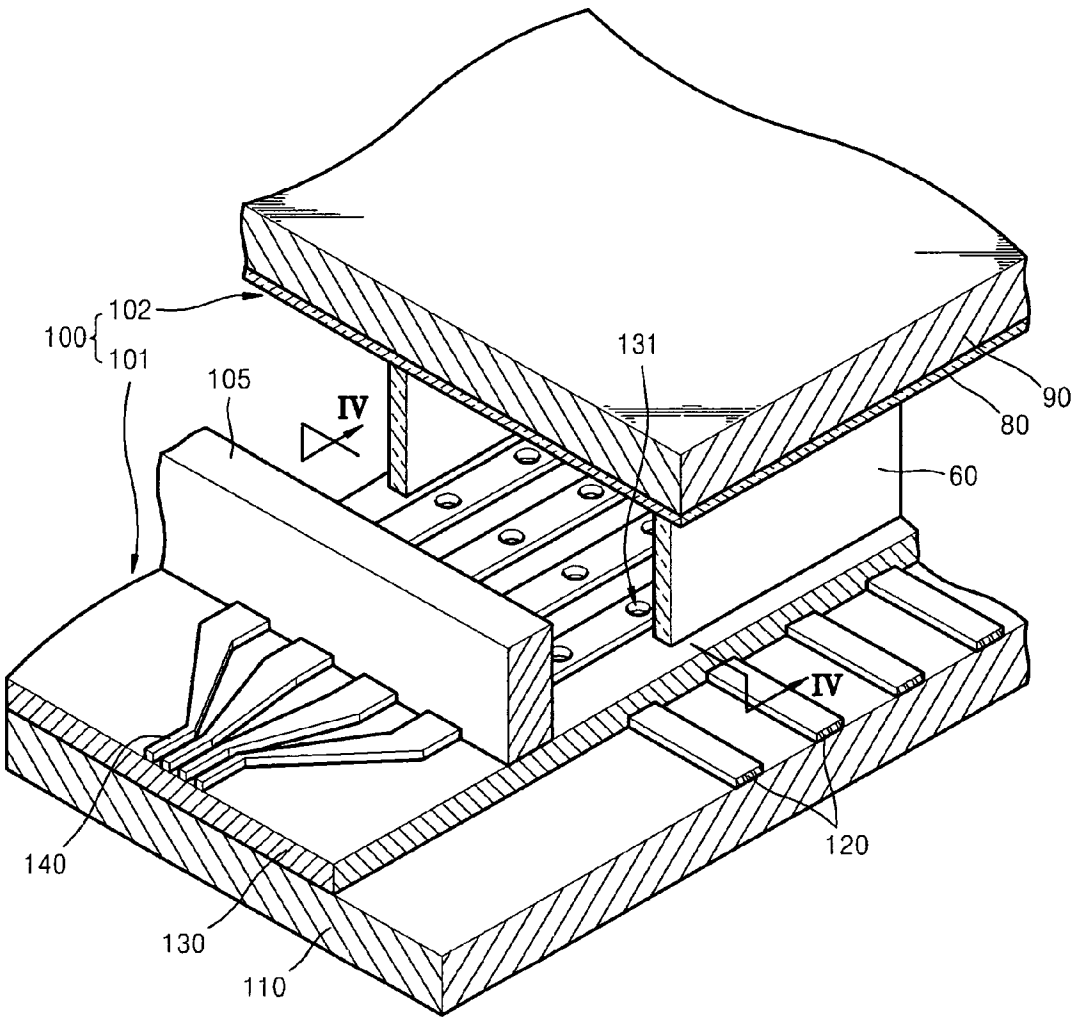
FIG. 3 is a partial perspective view of an electron emission display according to an embodiment of the present invention.
Figure 4:
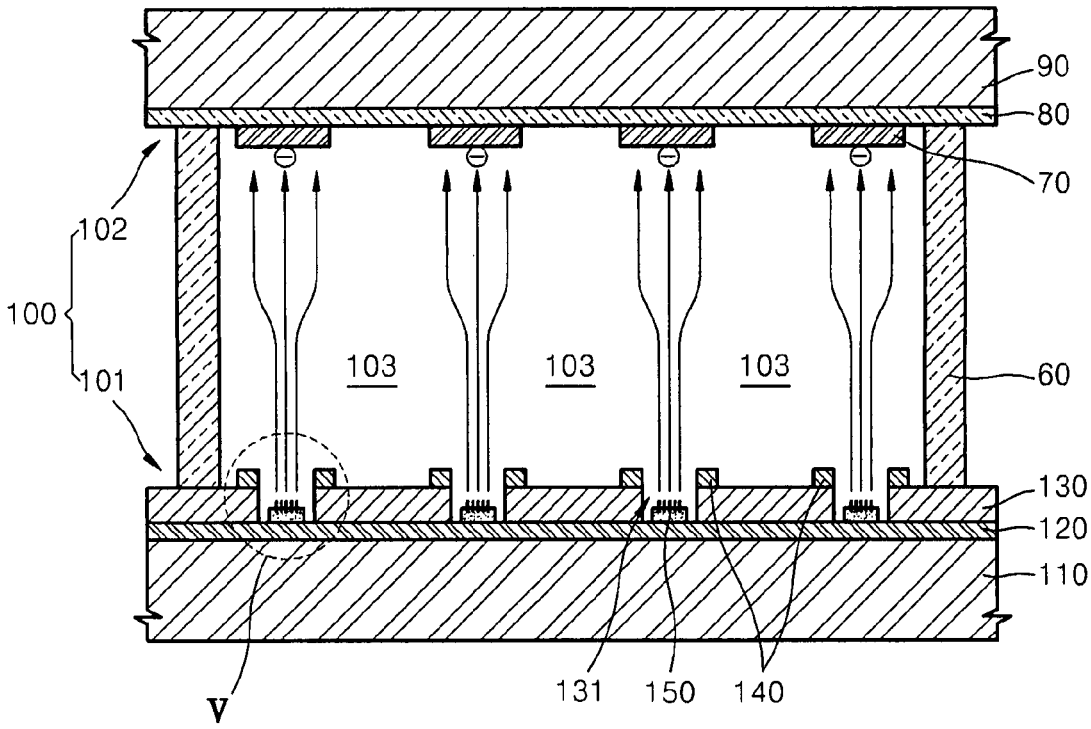
FIG. 4 is a cross-sectional view taken along line IV-IV of the electron emission display of FIG. 3.
Figure 5:
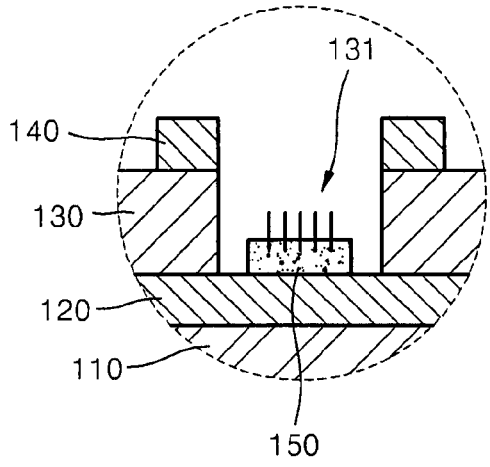
FIG. 5 is an enlarged view of portion V of the electron emission display of FIG. 4.
Figure 6:
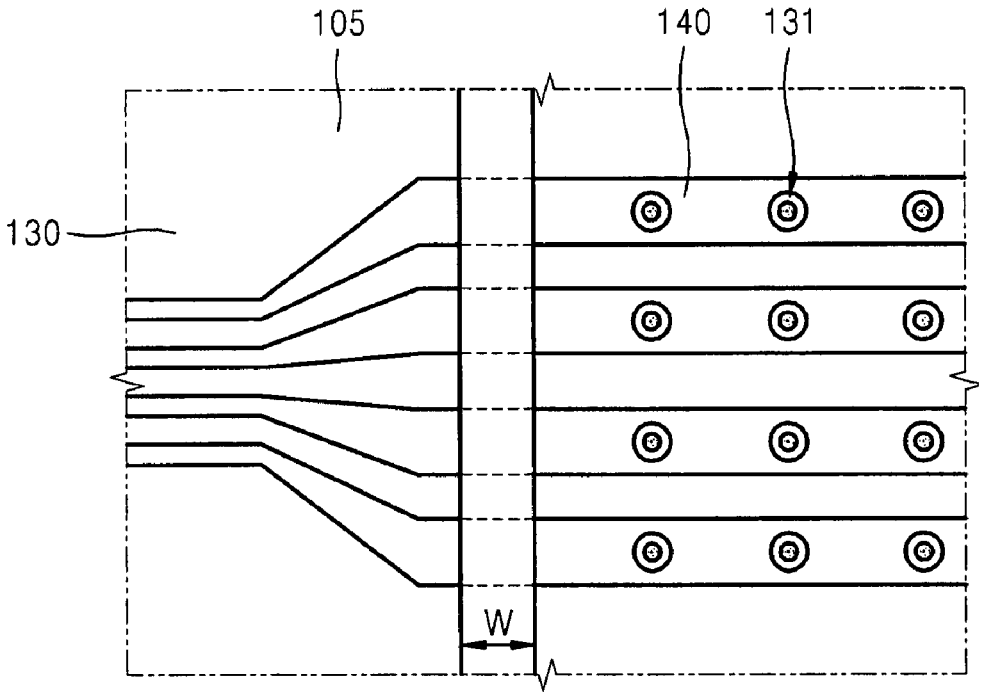
FIG. 6 is a plan view of an electron emission device that constitutes the electron emission display of FIG. 3.

FIG. 3 is a partial perspective view of an electron emission display 100 according to an embodiment of the present invention, and FIG. 4 is a cross-sectional view taken along line IV-IV of the electron emission display 100 of FIG. 3. FIG. 5 is an enlarged view of portion V of the electron emission display 100 of FIG. 4, and FIG. 6 is a plan view of the electron emission device 100 that constitutes the electron emission display of FIG. 3.

Referring to FIGS. 3 and 4, the electron emission display 100 includes an electron emission device 101 and a front panel 102 disposed in front of the electron emission device 101.

The electron emission device 101 includes a base substrate 110, cathodes 120, gate electrodes 140, a first insulating layer 130, and electron emission sources 150.

The base substrate 110 is a board member having a predetermined thickness, and can be a glass substrate formed of quartz glass, glass containing small amounts of impurities, such as Na, sheet glass, or glass coated with $SiO_2$, an oxide aluminum substrate, or a ceramic substrate. In order to realize a flexible display apparatus, the base substrate 110 can be formed of a flexible material.

The cathodes 120 extend in a direction on the base substrate 110, and can be formed of a conventional electrically conductive material, for example, a metal such as Al, Ti, Cr, Ni, Au, Ag, Mo, W, Pt, Cu, Pd, or an alloy of these metals; a metal such as Pd, Ag, $RuO_2$, Pd—Ag, or a printed conductive material comprising a metal oxide and glass; a transparent conductive material such as ITO, $In_2O_3$, or $SnO_2$; or a semiconductor material such as polysilicon. Particularly, when the process of transmitting light from the rear of the base substrate 110 is required, the cathodes 120 may be formed of a transparent conductive material such as ITO, $In_2O_3$, or $SnO_2$.

The gate electrodes 140 are insulated from the cathodes 120 by the first insulating layer 130. The gate electrodes 140 can be formed of a conventional electrically conductive material as the cathodes 120.

In order to realize images so as not to simply function as a lamp that generates visible light, the cathodes 120 and the gate electrodes 140 may be alternately disposed as depicted in FIG. 3. Also, in regions where the cathodes 120 and the gate electrodes 140 are alternately disposed, electron emission source holes 131 are formed to dispose electron emission sources 150.

The first insulating layer 130 is interposed between the gate electrodes 140 and the cathodes 120 to insulate there between, thereby preventing short circuits between the gate electrodes 140 and the cathodes 120.

The electron emission sources 150 are disposed to electrically connect to the cathodes 120 at a lower level with respect to the gate electrodes 140. The electron emission sources 150 can be formed of any material having a needle shape. In particular, the electron emission sources 150 may be formed of a carbon material such as Carbon Nano-Tubes (CNTs) having a low work function and a high B function, graphite, diamond, Diamond-Like Carbon (DLC), or a nano material, such as nano tubes, nano wires, and nano rods. In particular, the CNTs have an electron emission characteristic, and thus, enable driving an electron emission display at a low voltage. Therefore, the use of the CNTs as an electron emission source is advantageous for manufacturing a large screen display device.

In the electron emission device 101 having the above structure, electrons are emitted from the electron emission sources 150 due to an electric field formed between the cathodes 120 and the gate electrodes 140 when a negative voltage is supplied to the cathodes 120 and a positive voltage is supplied to the gate electrodes 140.

The front panel 102 includes a phosphor layer 70.

The phosphor layer 70 is formed of a Cathode Luminescence (CL) phosphor material that can generate visible light when the phosphor layer 70 is excited by accelerated electrons. Phosphor materials that can be used by the phosphor layer 70 include, for example, a red phosphor material, such as $SrTiO_3$:Pr, $Y_2O_3$:Eu, $Y_2O_3S$:Eu, etc., a green phosphor material, such as $Zn(Ga, Al)_2O_4$:Mn, $Y_3(Al, Ga)_5O_{12}$:Tb, $Y_2SiO_5$:Tb, ZnS:Cu, Al, etc., and a blue phosphor material, such as $Y_2SiO_5$:Ce, $ZnGa_2O_4$, ZnS:Ag, Cl, etc. However, the phosphor material of the present invention is not limited thereto.

The front panel 102 can further include a front substrate 90 and an anode 80 arranged on the front substrate 90.

The front substrate 90 is a board member having a predetermined thickness like the base substrate 110, and can be formed of the same material as the base substrate 110. The anode 80 is formed of a conventional electrically conductive material like the cathodes 120 and the gate electrodes 140. In particular, the anode 80 may be a transparent electrode so that visible light generated from the phosphor layer 70 can be transmitted forward.

The electron emission device 101 that includes the base substrate 110 and the front panel 102 that includes the front substrate 90 maintain a predetermined distance from each other to form a vacuum space 103. Spacers 60 are disposed between the electron emission device 101 and the front panel 102 to maintain a predetermined distance between the electron emission device 101 and the front panel 102, and can be formed of an insulating material.

Also, in order to maintain the vacuum space 103 formed by the electron emission device 101 and the front panel 102 in a vacuum state, edges of the vacuum space 103 are sealed using a sealing member 105, and then, the vacuum space 103 is evacuated. The sealing member 105 may be a glass frit.

The sealing member 105 contacts an upper surface of the electron emission device 101 when the sealing member 105 seals the edges of the vacuum space 103 formed by the electron emission device 101 and the front panel 102. The sealing member 105 contacts the gate electrodes 140 exposed on the upper surface of the electron emission device 101. The sealing member 105 must have a predetermined width W, refer to FIG. 6, so that the vacuum space 103 can be maintained at a predetermined vacuum state even if an external impact of a predetermined magnitude is applied to the sealing member 105. The sealing member 105 is located at an outside of the vacuum space 103 closer to the vacuum space 103 than end portions of the gate electrodes 140 having a narrow width to be connected to a terminal (not shown). That is, the sealing member 105 is disposed to contact a portion of the gate electrodes 140 where the width of the gate electrodes 140 is maintained uniform. In this way, when the sealing member 105 is disposed to contact portions of the gate electrodes 140 where the width of the gate electrodes 140 is maintained uniform, the width of the gate electrodes 140 exposed on an upper surface of the electron emission device 101 is wider than in the prior art and the sealing member 105 contacts portions of the gate electrodes 140 where resistance is low. Therefore, even if resistance in the gate electrodes 140 increases in the portions where the sealing member 105 contacts the gate electrodes 140, the magnitudes of the increase in resistance is low. Accordingly, an arc discharge or a wire disconnection at the contact points can be avoided.

The operation of the electron emission display 100 having the above structure is as follows.

A negative (−) voltage is supplied to the cathodes 120 and a positive (+) voltage is supplied to the gate electrodes 140 so that the electron emission sources 150 formed on the cathodes 120 can emit electrons. Also, a high positive (+) voltage is supplied to the anode 80 to accelerate the electrons towards the anode 80. When the high positive (+) voltage is supplied to the anode 80, the electrons emitted from the needle shaped material that constitutes the electron emission sources 150 proceed towards the gate electrodes 140, and then, are accelerated towards the anode 80. The electrons that accelerate towards the anode 80 collide with the phosphor layer 70. Then, the phosphor material of the phosphor layer 70 is excited and emits visible light.

Figure 7:
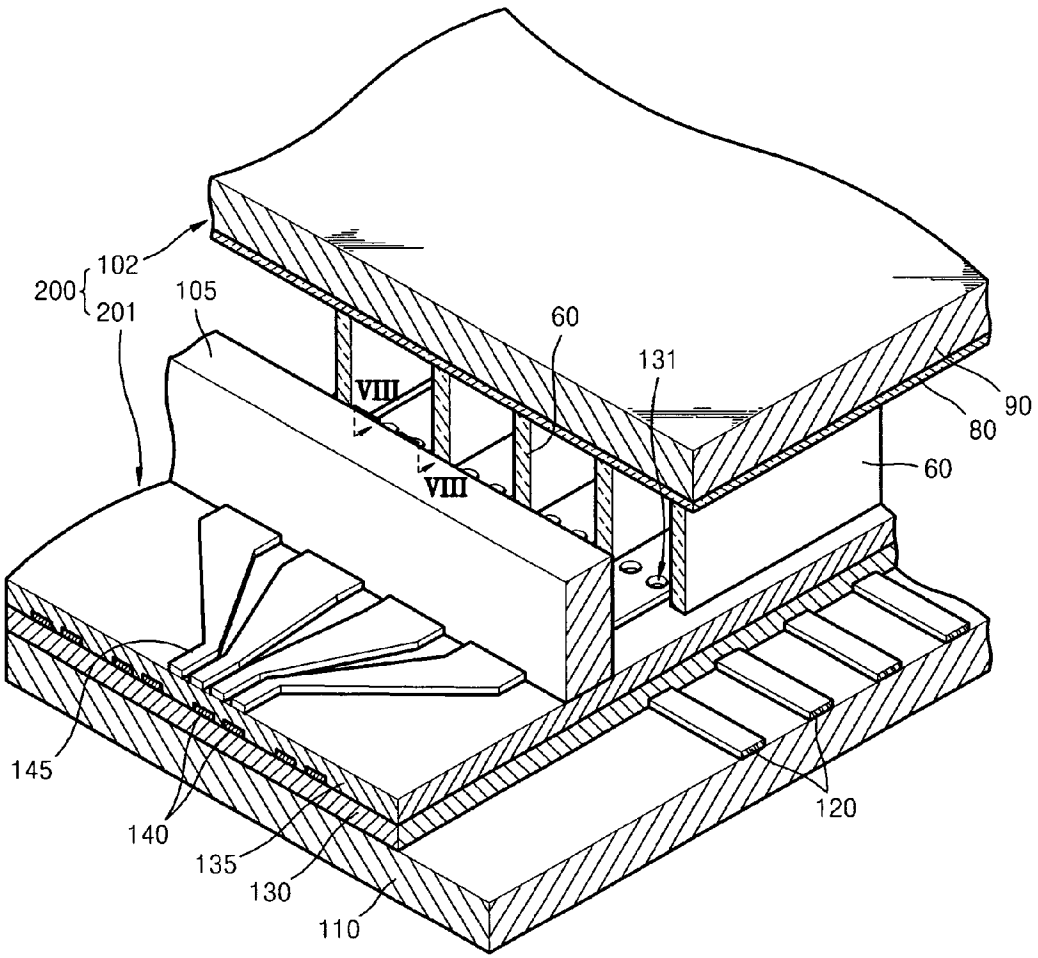
FIG. 7 is a partial perspective view of an electron emission display according to another embodiment of the present invention.
Figure 8:
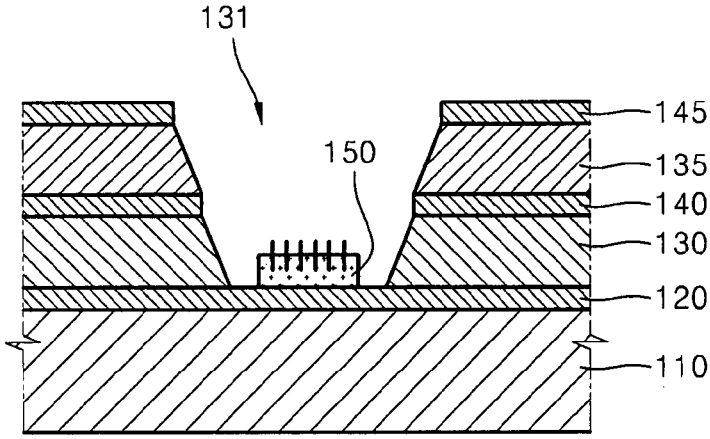
FIG. 8 is a cross-sectional view taken along line XIII-XIII of the electron emission display of FIG. 7.
Figure 9:
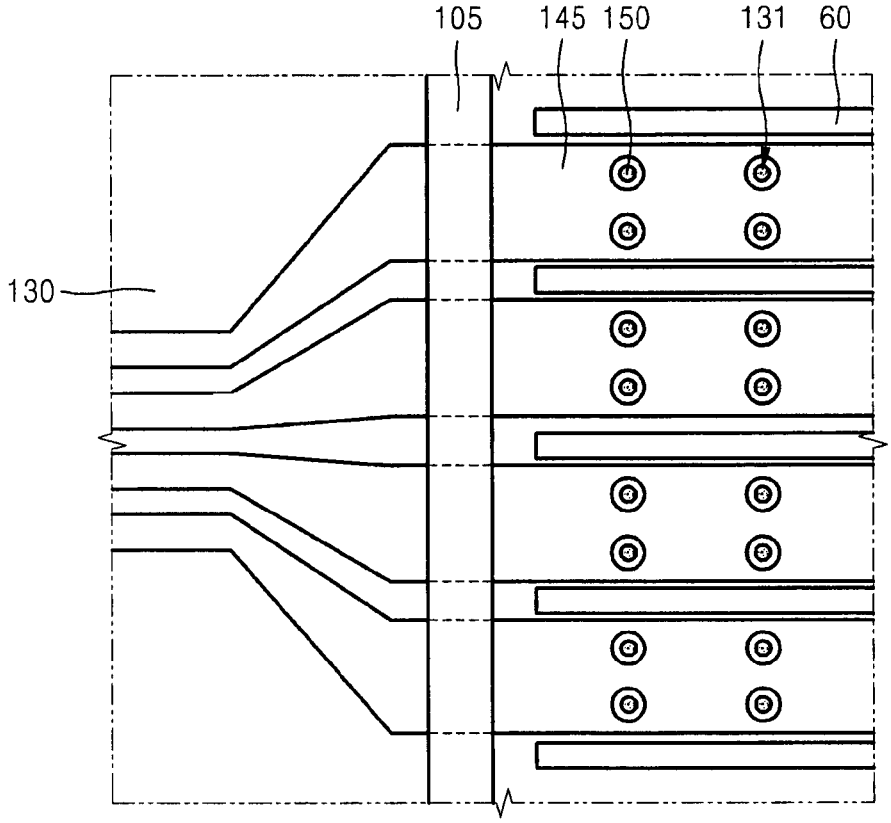
FIG. 9 is a plan view of an electron emission device that constitutes the electron emission display of FIG. 7.

FIGS. 7 and 8 are a partial perspective view of an electron emission display 200, and a cross-sectional view taken along line XIII-XIII of the electron emission display 200 of FIG. 7, respectively, according to another embodiment of the present invention.

Referring to FIGS. 7 and 8, if the electrodes exposed on an upper surface of an electron emission device 201 are focusing electrodes 145, the focusing electrodes 145 are disposed to contact a sealing member 105 at inner portions where the width of the focusing electrodes 145 has been narrowed. In this case also, as described with reference to FIG. 3, an area of contact between the focusing electrodes 145 and the sealing member 105 is increased. Therefore, the increase in resistance in the focusing electrodes 145 can be mitigated, and an arc discharge and a wire disconnection can be avoided when a current flows in the focusing electrodes 145, thereby realizing a stable driving of the electron emission display 200.

The electron emission device 201, according to the present embodiment, further includes a second insulating layer 135 covering an upper surface of the gate electrodes 140 of FIG. 3 and focusing electrodes 145 formed on the second insulating layer 135. When the focusing electrodes 145 are further included, electrons emitted from an electron emission source 150 can focus toward the phosphor layer 70 and can prevent the dispersion of the electrons in lateral directions.

In the electron emission display according to the present invention, the problems of an arc discharge and a wire disconnection in the electrodes can be prevented since a sealing member contacts the electrodes located on an upper surface of the electron emission device, thereby realizing a stable driving of the electron emission display.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. An electron emission display, comprising:

an electron emission device including electrodes having exposed upper surfaces, said electrodes having a first end and a second end, said first end of said electrodes having a narrower width than said second end of said electrodes, and said first end of electrodes arranged at an end portion of the electron emission device and connected to an external power source;

a front panel arranged in front of the electron emission device, the front panel having a phosphor material; and a sealing member adapted to maintain the vacuum space formed by the electron emission device and the front panel in a vacuum state, the sealing member being disposed on edges of the space contacting the second end of said electrodes;

wherein the electrodes are arranged on an entire surface of the electron emission device; and said second end of said electrodes arranged in at least a portion of said space, wherein the sealing member crossing the electrodes at a point having the width of said second end and not contacting said first end of said electrodes, and wherein prior to said point of crossing of the electrodes with said sealing member, said electrodes have a uniform width and are parallel to one another, wherein the electron emission device comprises:

a base substrate;

a plurality of cathodes arranged on the base substrate; and a plurality of gate electrodes electrically insulated from the cathodes;

wherein the electrodes exposed on an upper surface of the base substrate are gate electrodes to which a higher voltage than the cathode is supplied.

2. The electron emission display of claim 1, wherein the phosphor material generates visible light upon being excited by accelerated electrons.

3. The electron emission display of claim 1, wherein the front panel further comprises:

a front substrate arranged parallel to the electron emission device and facing the electron emission device; and an anode arranged under the front substrate close to the phosphor material to accelerate electrons emitted by an electron emission source toward the phosphor material.

4. The electron emission display of claim 1, wherein the sealing member comprises frit glass.

5. An electron emission display having a base substrate and a front panel, said electron emission display comprising:

a plurality of cathodes disposed on an upper surface of said base substrate, said cathodes extending in a first direction;

an insulating layer covering said base substrate and said cathodes;

a plurality of electrodes disposed on an upper surface of said insulating layer, said electrodes each having an extended portion of a first width, said extended portions crossing over said cathodes in a second direction perpendicular to the first direction, said electrodes each having a terminal portion of a second width less than said first width, and said electrodes each having another portion extending between said terminal portion and said extended portion, said another portion increasing in width from said second width to said first width; and a sealing member adapted to maintain a vacuum space between said base substrate and said front panel, said sealing member being disposed on said insulating layer and crossing the extended portions of said electrodes in said first direction.

6. The electron emission display as set forth in claim 5, said sealing member comprising frit glass.

7. The electron emission display as set forth in claim 5, said front panel comprising:

a front substrate;

an anode layer disposed on a rear surface of said front substrate; and a plurality of phosphor layers disposed on a rear surface of said anode layer.

8. The electron emission display as set forth in claim 7, further comprising a plurality of spacers disposed between said insulating layer and said anode layer to maintain a predetermine distance between said insulating layer and said front panel.

9. The electron emission display as set forth in claim 7, further comprising:

a plurality of apertures formed in said extended portions of said electrodes where the extended portions cross over said cathodes; and a plurality of electron emission sources formed on said cathodes to provide emitted electrons to said phosphor layers through said apertures.

10. The electron emission display as set forth in claim 5, said plurality of electrodes comprising gate electrodes.

11. The electron emission display as set forth in claim 5, said plurality of electrodes comprising focusing electrodes.

12. The electron emission display as set forth in claim 11, said insulating layer comprising:

a first insulating layer covering said base substrate and said cathodes;

a plurality of gate electrodes extending in said second direction; and a second insulating layer covering said first insulating layer and said plurality of gate electrodes.

13. The electron emission display as set forth in claim 12, further comprising a plurality of spacers disposed between said second insulating layer and said anode layer to maintain a predetermine distance between said second insulating layer and said front panel.

14. The electron emission display as set forth in claim 12, further comprising:

a plurality of apertures formed in said extended portions of said focusing electrodes where the extended portions cross over said cathodes; and a plurality of electron emission sources formed on said cathodes to provide emitted electrons to said phosphor layers through said apertures.

* * * * *